US006941586B1

(12) United States Patent
Weinhold

(10) Patent No.: US 6,941,586 B1
(45) Date of Patent: Sep. 13, 2005

(54) SHOULDER PAD

(76) Inventor: Mark S. Weinhold, 28080 SW. Canyon Creed Rd., Wilsonville, OR (US) 97070

( * ) Notice: Subject to any disclaimer, the term of this patent is extended or adjusted under 35 U.S.C. 154(b) by 0 days.

(21) Appl. No.: 10/942,245

(22) Filed: Sep. 15, 2004

(51) Int. Cl.[7] ..... A41D 13/00

(52) U.S. Cl. ..... 2/459

(58) Field of Search ..... 2/459, 268, 455, 2/44, 45, 468, 327, 908, 461, 467; 128/878, 128/876; 602/4, 5, 20, 62; 224/257, 264, 224/265, 600

(56) References Cited

U.S. PATENT DOCUMENTS

| | | | | |
|---|---|---|---|---|
| 3,906,944 | A * | 9/1975 | Christen | 128/869 |
| 5,188,587 | A * | 2/1993 | McGuire et al. | 602/20 |
| 6,079,055 | A * | 6/2000 | Mencel | 2/459 |
| 6,145,134 | A * | 11/2000 | Davis et al. | 2/463 |
| 6,202,214 | B1 * | 3/2001 | Light | 2/45 |
| 6,678,895 | B1 * | 1/2004 | Grilliot et al. | 2/81 |

* cited by examiner

*Primary Examiner*—Tejash Patel
(74) *Attorney, Agent, or Firm*—Blakely Sokoloff Taylor & Zafman

(57) ABSTRACT

An embodiment of the invention is a pad that detachably engages around a user's shoulder and upper torso to pad the user's shoulder against objects borne over and against the user's shoulder.

20 Claims, 4 Drawing Sheets

SHOULDER PAD

FIELD

Embodiments of the invention pertain to personal protective equipment, and more particularly to a protective device to aid carrying objects over one's shoulder.

BACKGROUND

Construction can be a profession, pastime, or chore, and often times a combination thereof. To improve the ability and ease with which they perform construction-related tasks, workers have developed a vast range of tools, equipment, and accessories to lighten their construction burden.

Shoulder injuries are commonplace, and can be particularly nagging for those who regularly lift objects above their heads. A shoulder injury, once sustained, may ultimately lead to workers compensation, lost work days, or other inefficiencies desirable neither to an employer nor a worker. Further, an injured individual may, because of postural changes to compensate for their shoulder injury, secondarily injure their back causing additional work-related complications. The shoulder injury may further interfere with leisure and recreational activities for the injured individual.

Anyone who periodically or regularly carries objects (e.g., lumber, piping, conduit, boxes, or similar objects) over their shoulder would smile upon a device that reduces the level of strain and pain caused by carrying such objects.

BRIEF DESCRIPTION OF THE DRAWINGS

The present invention will be understood more fully from the detailed description given below in conjunction with the accompanying illustrations of an embodiment or embodiments of the invention. The illustrations, however, should not be taken to limit the invention, but are for explanation and understanding only.

Figure 1:
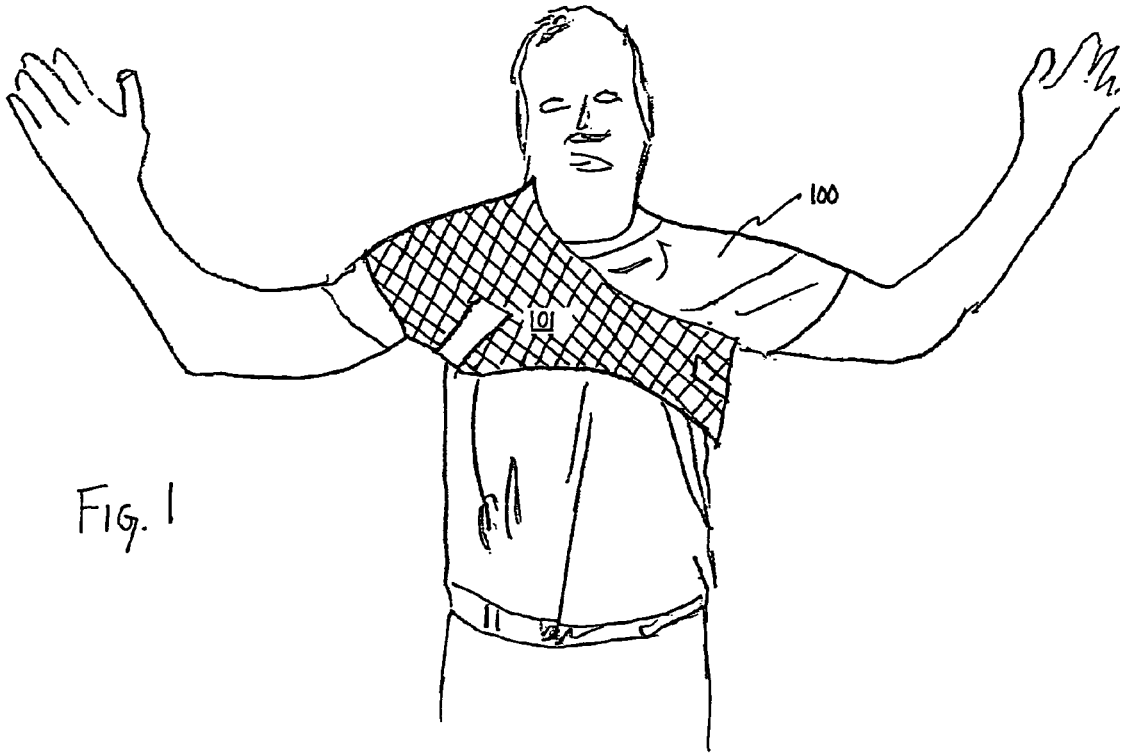
FIG. 1: illustration of an anterior view of a user wearing a shoulder saver of an embodiment.

It is noted that the drawings of embodiments are merely schematic representations and are not intended to portray specific parameters of the invention. The drawings are intended to depict only typical embodiments of the invention, and therefore should not be considered as limiting the scope of the invention.

DETAILED DESCRIPTION

Embodiments of a shoulder saver will be described. Reference will now be made in detail to a description of these embodiments as illustrated in the drawings. While the embodiments will be described in connection with these drawings, there is no intent to limit them to drawings disclosed herein. On the contrary, the intent is to cover all alternatives, modifications, and equivalents within the spirit and scope of the described embodiments as defined by the accompanying claims.

Simply stated, an embodiment of the invention is a pad that detachably engages around a user's shoulder and upper torso to pad and protect the user's shoulder against objects borne over and against the user's shoulder.

FIG. 1 illustrates the shoulder saver 101 of an embodiment detachably engaged around the upper torso and shoulder of a user 100. The shoulder saver 101 of an embodiment substantially secures a pad contained therein over the top surface of the shoulder. The shoulder saver 101 of an embodiment is further configured to interfere minimally with the range of motion of each of the user's 100 arms as the shoulder saver 101 does not extend down the upper arms of the user 100, thereby potentially constricting the arms motion about the shoulder.

Figure 2:
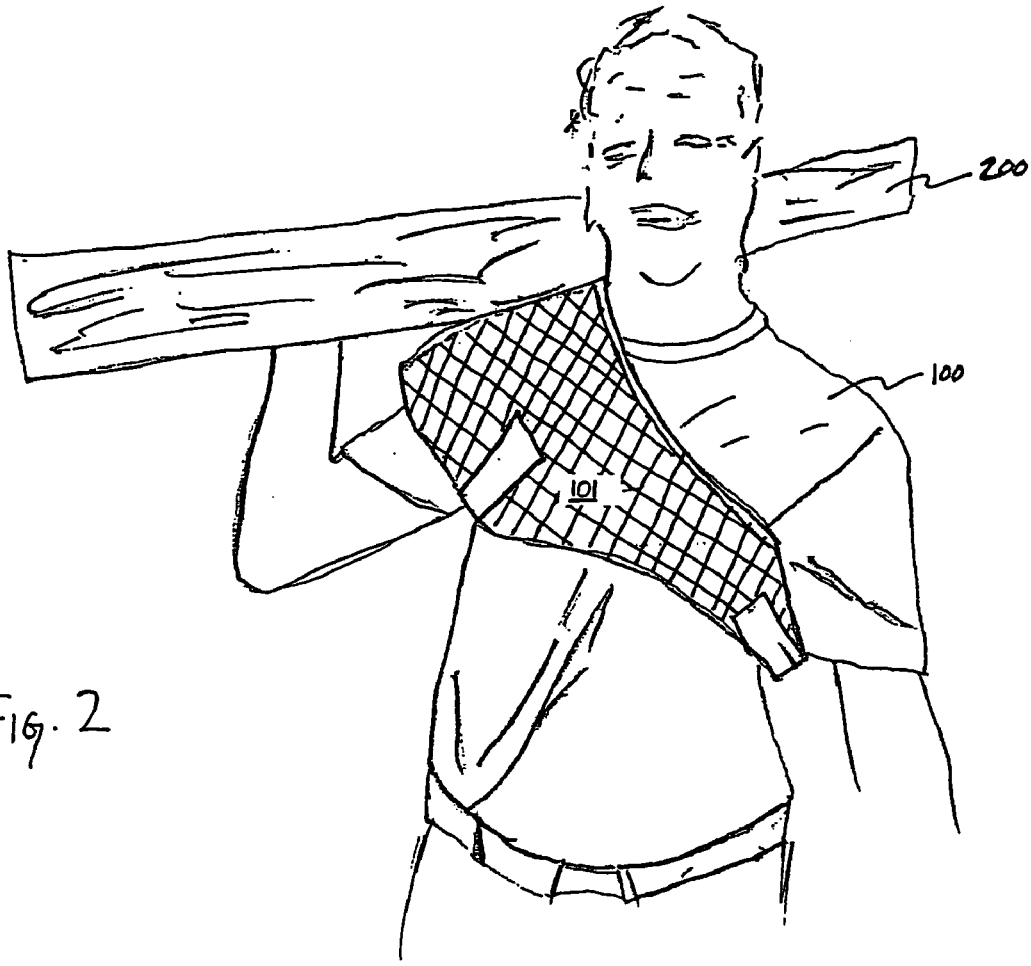
FIG. 2: illustration of an anterior view of a user wearing a shoulder saver of an embodiment and carrying an object.

FIG. 2 illustrates the shoulder saver 101 of an embodiment detachably engaged around the upper torso and shoulder of a user 100 carrying an object 200. The substantially secured pad contained in the shoulder saver 101 is positioned above and in contact with the user's 100 shoulder between the shoulder and the carried object. The pad distributes the mass of the object 200 substantially uniformly over the surface of the pad, reducing the object mass per unit area experienced by the user's 100 shoulder. As noted with respect to FIG. 1, the shoulder saver of an embodiment is further configured to interfere minimally with the range of motion of each of the user's 100 arms so that, for example, the user 100 can secure the object 200 carried atop their shoulder with the same arm.

The shoulder saver 101 including a pad distributes the object 200 mass in particular, and among other features, over the user's clavicle, acromion, coracoid process and scapula skeletal features as well as the deltoid (anterior, lateral, and posterior), supra spinatus, upper fibers of the trapezius, and levator scapulae muscular features as is well know to those in the medical and anatomical arts.

Figure 3:
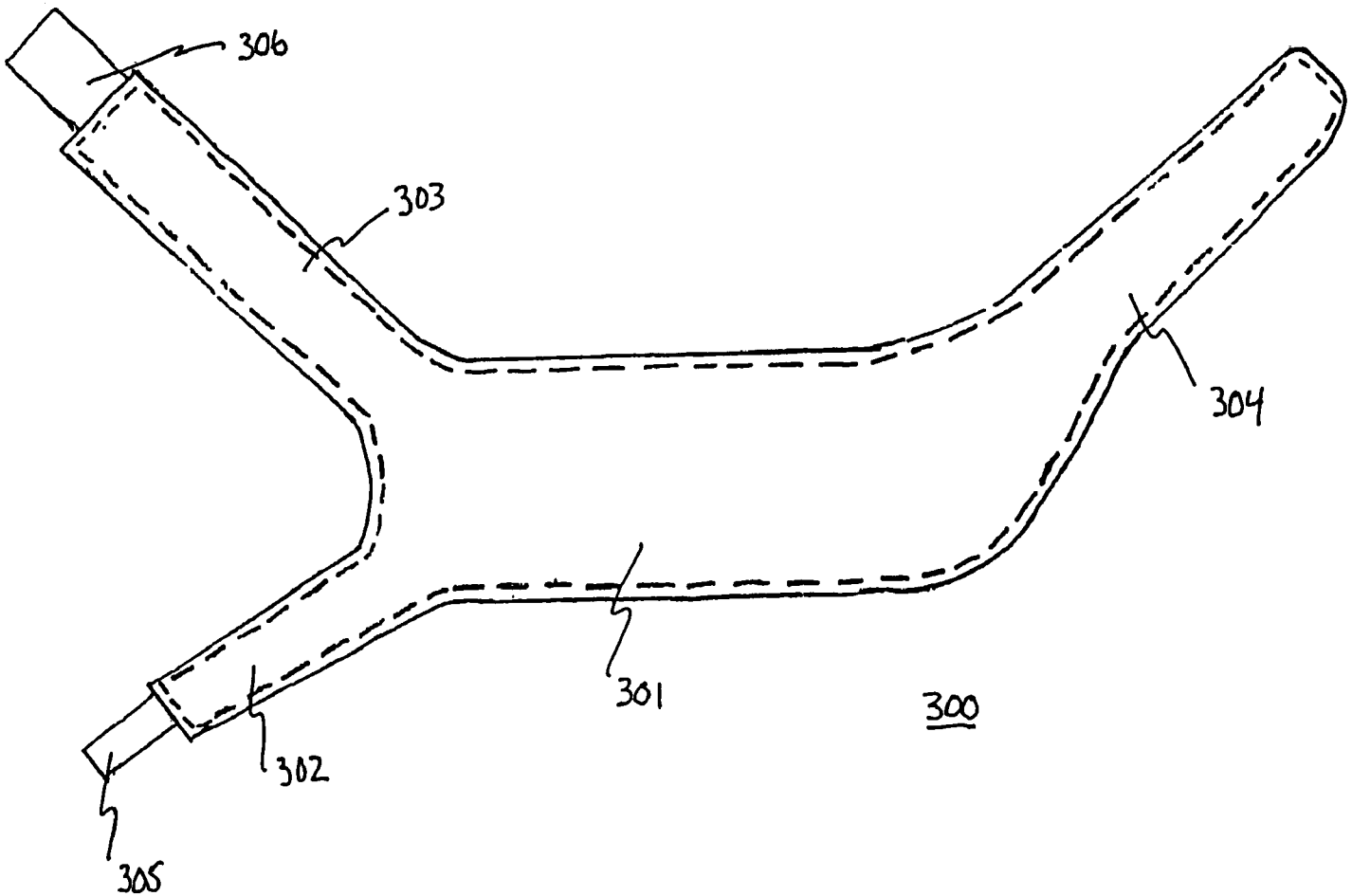
FIG. 3: illustration of a distal side of a shoulder saver of an embodiment disengaged from a user.

FIG. 3 illustrates a distal side of the shoulder saver 300 of an embodiment detached from the user 100. Overall, the shape of the shoulder saver 300 approximately resembles a lower case "y." In an embodiment, the shoulder saver 300 includes a body portion 301 and a plurality of strap portions configured to detachably engage between and among other strap portions and the body portion 301. For example, the body portion 301 of an embodiment includes at an end both a first strap portion 302 and a second strap portion 303 extending from the body portion 301 on the same side of the body portion 301. The body portion 301 of an embodiment further includes a third strap portion 304 extending from the body portion 301 on approximately the opposite side of the body portion 301 from the first and second strap portions 302 and 303. It is to be understood that the any individual strap portion 302–304 may be fabricated as a continuation to or appendage of the body portion 301 material or may be a separate piece or pieces of material that are attached to the body portion 301.

The shoulder saver 300 of an embodiment can be manufactured in a variety of materials to suit a particular use, climate requirement, durability, and wear resistance. For example, in an embodiment, the body portion and first, second, and third strap portions 302–304 are neoprene. The neoprene can stretch to conform to the user's 100 upper torso as the shoulder saver 100 is detachably engaged around the upper torso and shoulder of the user as illustrated by FIGS. 1 and 2. The neoprene can further include both a textured rubber-like side in contact with the user's shoulder and upper torso to substantially secure the shoulder saver 300 in place and a fabric side opposite the rubber-like side to resist wear and to provide a mechanism by which the first, second, and third strap portions 302–304 may detachably engage. For example, the fabric side of the shoulder saver 300 may contain loops for a hook and loop fastening system.

The shoulder saver 300 may further be manufactured of polyester, nylon, or veltex, lycra, EPDM (Ethylene Propylene Diene Monomer), nubuck, leather, or combinations thereof. The material may be a monolithic weave or it may be an open mesh to enhance air exchange and breathability for use in climates that would benefit from the venting. As noted, any individual or combinations of strap portions 302–304 may a different material than the body portion 301. Further, an individual strap portion or strap portions may further include an elastic to aid sizing the shoulder saver 300 and maintaining the shoulder saver 300 pad's proper position if the body portion 301 and/or strap portions 302–304 are not inherently elastic (e.g., if not manufactured from neoprene or other similarly elastic material).

Any individual portion or portions of the shoulder saver 300 may further be formed of multiple materials. For example, a portion of the shoulder saver 300 could be two or more layers of distinct or alternating materials, for example, stitched, adhered, or otherwise attached together. Further, the layers need not completely overlap. For example, the shoulder saver 300 may be fabricated predominantly from neoprene with an abrasion resistant material added to the distal surface of the shoulder saver 300 superior to the user's 100 shoulder to resist wear from carrying object 200.

The first strap portion 302 and the second strap portion 303 of an embodiment include means to non-permanently attach to the third strap portion 304 or body portion 301 when the shoulder saver 300 is detachably engaged around the user's 100 upper torso and shoulder. To don the shoulder saver 300, the user 100 wishing to hold the object 200 over their left shoulder would first align the shoulder saver's 300 pad over the left shoulder area described above with reference to skeletal and muscular features with the first and second strap portions 302 and 303 extending in the posterior direction and the third strap portion 304 extending in the anterior direction. Holding the third strap portion with their left or right hand, the user 100 can reach with their other hand for the second strap portion 303 around the right side of his upper torso approximately at the intersection of his thoracic and abdominal regions and detachably engage the second strap portion 303 with the third strap portion 304. The user 100 can then, reaching with either hand, grasp the first strap portion 302 from the left upper torso and beneath the left arm and detachably engage the first strap portion 302 with the third strap portion 304. Alternatively, the user 100 may detachably engage the first strap portion 302 before the second strap portion 303.

With such a configuration, the shoulder saver 300 is substantially securely engaged around the user's 100 upper torso and shoulder, holding the body portion 301 including a pad is in the proper position as illustrated by FIGS. 1 and 2. The detachability of the shoulder saver 300 allows the shoulder saver 300 to be put on over clothing and without, for example, putting on like a tee-shirt whereby the user 100 would have to extend his arm and head through fixed openings. Further, the strap portions 302–304 can be detachably engaged in a variety of orientations to accommodate multiple torso sizes and shapes for a given shoulder saver 300 size. It is to be understood that a shoulder saver 300 may also protect the user's 100 right shoulder, in which case the shoulder saver 300 of an embodiment and method of donning the shoulder saver 300 would be an approximate reflection over the user's 100 midsagittal plane. The shoulder saver 300 of an embodiment has an orientation commensurate with protecting either the left shoulder or the right shoulder. In another embodiment the shoulder saver 300 may accommodate either shoulder substantially equally.

As noted, the shoulder saver 300 of an embodiment detachably engages around a user's 100 upper torso and shoulder. There are a numerous mechanisms by which the strap portions 302–304 can detachably engage. In an embodiment, first and second strap portions 302 and 303 include half of a hook and loop fastener system 305 and 306 respectively while the distal surface of the third strap portion 304 includes the complementary half of the hook and loop fastener system. In an embodiment, the hook and loop fastener system is VELCRO. In another embodiment, hook systems 305 and 306 detachably engage with the distal surface material of third strap portion 304 as the distal surface material is a loop-containing fabric. It is to be understood that different detachable engagement means may be utilized. For example, the first and second strap portions 302 and 303 may detachably engage with the third strap portion 304 with a snap, a buckle, a side release buckle that can be dual or single adjusting, a center release buckle, a cam buckle, a spring snap, a snap hook, or any other mechanism well known in the detachable engagement art. It is to be further understood that for the aforementioned buckles, the male or female buckle portion can be included as part of the first and second strap portions 302 and 303 while the complementary gender buckle portion can be included as part of the strap portion 304. As noted, the first and second strap portions 302 and 303 may include an elastic portion to aid sizing and securing of the shoulder saver 300.

Figure 4:
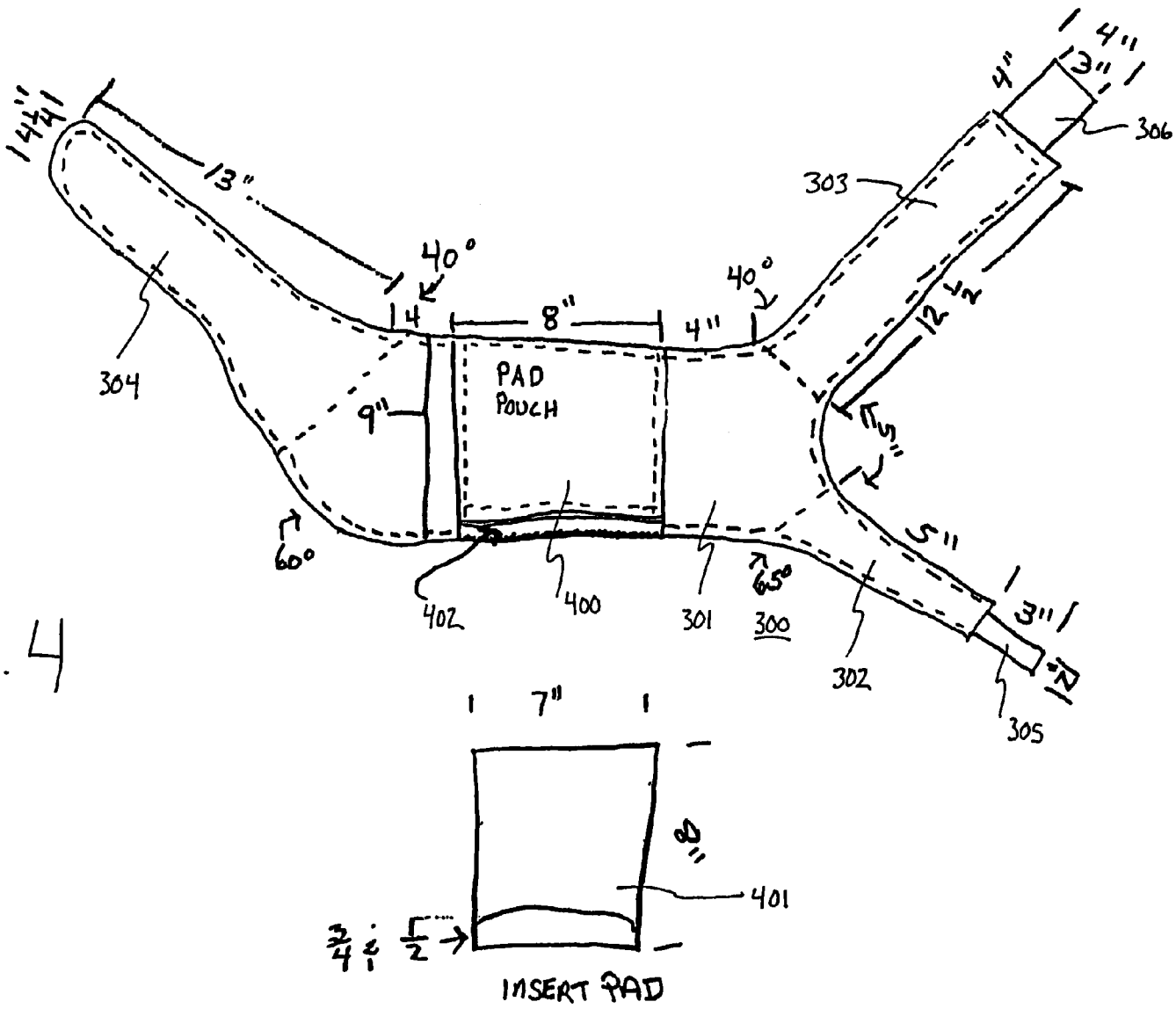
FIG. 4: illustration of a proximal side of a shoulder saver of an embodiment disengaged from a user.

FIG. 4 illustrates a proximal side of the shoulder saver 300 of an embodiment detached from a user 100. In an embodiment, the body portion 301 includes a pad pouch 400 into which a pad 401 can be inserted and removed so that, for example, the pad 401 material or configuration can be altered, the shoulder saver can be washed, or the pad 401 be replaced. The pad pouch 400 may also include a fastener 402 to substantially secure the pad 401 in the pad pouch 400. In an embodiment the fastener is a hook and loop fastener system. In an embodiment the hook and loop fastener system is VELCRO. In another embodiment, the pad 401 is included in the body portion 301 and cannot be removed.

The pad 401 material can be any material that offers padding and that can distribute the mass of object 200 over the user's 100 shoulder. For example, the pad 401 material may be a foam (closed or open cell), gel, fabric, leather, metal plate, metal mesh, liquid chamber, air chamber, or combination thereof. In an embodiment, the pad 401 material is hydrochloric foam.

FIG. 4 further illustrates representative dimensions for the body portion 301 and the strap portions 302–304 including approximate lengths and widths, as well as approximate angles between the various constituent portions of the shoulder saver 300. It is to be understood that the shoulder saver 300 of an embodiment is not limited to the exemplary dimensions, and that alternate configurations of the shoulder saver 300 are possible within the spirit and scope of the claims.

In addition to the previously indicated variations, numerous other modifications and alternative arrangements may be devised by those skilled in the art without departing from the spirit and scope of embodiments of the present invention as defined in the appended claims. Further, while embodiments of the present invention have been described above with particularity and detail, it will be apparent to those of ordinary skill in the art that numerous modifications, including, but not limited to, variations in size, materials, shape, form, function, manner of operation, assembly, and use may be made without departing from the principles and concepts set forth herein.

One skilled in the art will recognize the elegance of the disclosed embodiment in that it improves the ability with which a person can carry an object or objects over their shoulder.

What is claimed is:

1. An apparatus comprising:

a body portion including a pad;

a first strap portion extending from a first end of the body portion;

a second strap portion extending from the first end of the body portion and adjacent to the first strap portion; and a third strap portion extending from a second end of the body portion approximately opposite of the first end, the first and second strap portions to detachably engage with the third strap portion to secure the pad over a shoulder of a user.

2. The apparatus of claim 1, the first, second, and third strap portions further comprising a hook and loop fastening system to detachably engage the first and second strap portions with the third strap portion.

3. The apparatus of claim 1, the first and second strap portions further comprising a hook fastening system to detachably engage with a surface of the third strap portion.

4. The apparatus of claim 1, the first, second, and third strap portions further comprising a fastener selected from the group consisting of a snap, a buckle, a single adjusting side release buckle, dual adjusting side release buckle, a center release buckle, a cam buckle, a spring snap, and a snap hook.

5. The apparatus of claim 1, the body portion further comprising a pad pouch.

6. The apparatus of claim 5, the pad pouch further comprising a fastener to substantially secure the pad in the body portion.

7. The apparatus of claim 1 wherein the pad comprises a material selected from the group consisting of closed cell foam, open cell foam, gel, fabric, leather, metal, and a combination thereof.

8. The apparatus of claim 1 wherein the pad comprises hydrochloric foam.

9. The apparatus of claim 1 wherein the pad comprises one of a liquid chamber, an air chamber, or a combination thereof.

10. The apparatus of claim 1, at least one of the body portion, first strap portion, second strap portion, or third strap portion further comprising a material selected from the group consisting of neoprene, polyester, nylon, veltex, lycra, EPDM, nubuck, leather and a combination thereof.

11. The apparatus of claim 1, the body portion, first strap portion, second strap portion, and third strap portion further comprising a material selected from the group consisting of neoprene, polyester, nylon, veltex, lycra, EPDM, nubuck, leather, and a combination thereof.

12. An apparatus comprising:

a body portion including a pad pouch;

a first strap portion including a hook fastener extending from a first end the body portion;

a second strap portion including a hook fastener extending from the first end the body portion and adjacent to the first strap portion; and a third strap portion including a loop fastener extending from a second end of the body portion approximately opposite of the first end, the hook fasteners of the first and second strap portions to detachably engage with the loop fasteners of the third strap portion to secure a pad contained within the pad pouch over a shoulder of a user.

13. The apparatus of claim 12, at least one of the body portion, first strap portion, second strap portion, or third strap portion further comprising a material selected from the group consisting of neoprene, polyester, nylon, veltex, lycra, EPDM, nubuck, leather and a combination thereof.

14. The apparatus of claim 12, the body portion, first strap portion, second strap portion, and third strap portion further comprising a material selected from the group consisting of neoprene, polyester, nylon, veltex, lycra, EPDM, nubuck, leather, and a combination thereof.

15. The apparatus of claim 12, the pad pouch further comprising a fastener to substantially secure a pad in the body portion.

16. The apparatus of claim 15 wherein the pad comprises a material selected from the group consisting of closed cell foam, open cell foam, gel, fabric, leather, metal, and a combination thereof.

17. The apparatus of claim 15 wherein the pad comprises hydrochloric foam.

18. The apparatus of claim 15 wherein the pad comprises one of a liquid chamber, an air chamber, or a combination thereof.

19. An apparatus comprising:

a body portion including a pad;

a first strap portion extending from a first end of the body portion, the first strap portion to extend over the posterior side of a shoulder;

a second strap portion extending from the first end of the body portion and adjacent to the first strap portion, the second strap portion to extend over the posterior side of the shoulder; and a third strap portion extending from a second end of the body portion approximately opposite of the first end, the third strap portion to extend over the anterior side of the shoulder and the anterior side of a torso, the first strap portion to wrap beneath the inferior side of the shoulder and to detachably engage with the third strap portion on the anterior side of the torso, and the second strap portion to wrap around the posterior side of the torso and the lateral side of the torso opposite the shoulder and to detachably engage with the third strap portion on the anterior side of the torso to secure the pad over the shoulder.

20. The apparatus of claim 19, the first, second, and third strap portions further comprising a hook and loop fastening system to detachably engage the first and second strap portions with the third strap portion.

* * * * *